US005927602A

United States Patent [19]

Robisch et al.

[11] Patent Number: 5,927,602

[45] **Date of Patent: *Jul. 27, 1999**

[54] AIR BRUSH WITH REMOVABLE PAINT REGULATING NEEDLE

[75] Inventors: Herman Robisch, Schiller Park; Kenneth W. Schlotfeldt, Addison, both of Ill.

[73] Assignee: Badger Air Brush Co., Franklin Park, Ill.

[ * ] Notice: This patent is subject to a terminal disclaimer.

[21] Appl. No.: 09/088,169

[22] Filed: Jun. 1, 1998

Related U.S. Application Data

[63] Continuation of application No. 08/658,055, Jun. 4, 1996, Pat. No. 5,779,157.

[51] Int. Cl.[6] ..... B05B 17/00; B05B 7/30

[52] U.S. Cl. ..... 239/1; 239/346; 239/419; 239/600

[58] Field of Search ..... 239/300, 302, 239/303, 305, 310, 316, 318, 346, 600, 419, 1, 114, 115, 116, 123

[56] References Cited

U.S. PATENT DOCUMENTS

| | | | |
|---|---|---|---|
| 1,703,359 | 2/1929 | Paasche | 239/346 X |
| 2,264,564 | 12/1941 | Connor | 239/346 |
| 4,161,289 | 7/1979 | Rebold | 239/346 |

*Primary Examiner*—Andres Kashnikow
*Assistant Examiner*—Steven J. Ganey
*Attorney, Agent, or Firm*—Gerstman, Ellis & McMillin, Ltd.

[57] ABSTRACT

An air brush is provided with a handle, a front body and a paint regulating needle. The handle and the front body together define a tubular cavity through which the paint regulating needle is carried. A needle chuck releasably holds the paint regulating needle in the tubular cavity. The handle further defines a portal through which the needle chuck may be accessed. One end of the paint regulating needle extends outside of the handle and defines a stop and its other end extends through the handle and the front body. The needle chuck may be loosened, at the portal, to release the needle. The needle can then be grasped at the stop and pulled out of the airbrush so that the needle can be cleaned or replaced without disassembling the airbrush.

9 Claims, 3 Drawing Sheets

40a
41
40
32
42
16
38
38a
18
34
22
36
54b
12
60
54
54d
50
16a
54a
54c
46b
10
42
48
44
31
14a
52a
52
31
14
20
52a
46
24
24a
24b
26
42
40
28
14b
30b
30
30a
62
30a
14b
14
28
30
38a
16a
54b
54a
54
60
12
10
14
24b
24
24a
28
30

AIR BRUSH WITH REMOVABLE PAINT REGULATING NEEDLE

This application is a continuation of U.S. application Ser. No. 08/658,055 filed Jun. 4, 1996, now U.S. Pat. No. 5,779,157. This application is related to U.S. application Ser. No. 08/470,931, now U.S. Pat. No. 5,687,913.

FIELD OF THE INVENTION

The present invention concerns a novel air brush from which a paint regulating needle may be removed without disassembling the airbrush.

BACKGROUND OF THE INVENTION

Air brushes have found uses in a variety of industries and have been used by hobbyists and artists. However, the use of air brushes by serious artists has been hampered in that air brushes have generally not provided the easiest means through which the airbrush may be cleaned to maintain accuracy and efficacy.

Sophisticated air brushes generally have dual action triggers. In the use of such triggers, pushing the trigger down provides for the flow of pressurized air through the air brush. The air is used to propel paint. Pulling the trigger back, towards the user, allows the flow of paint. The paint can then be propelled by the air towards the object to be painted. The dual action of pushing the trigger down and pulling the trigger back causes air to flow and propel paint towards a desired object.

In the operation of the trigger, the further back the trigger is pulled the greater the flow of paint that is allowed to be propelled. In many air brushes the trigger is attached to a needle which is spring biased so that the needle, at rest, is pushed forward within the air brush's paint path. The needle is pushed towards an opening through which paint is propelled when the air brush is in operation. When the needle is all the way forward, as when it is in the rest position, the paint flow opening is completely closed. As the needle is pulled back, by the operation of the trigger, paint is allowed to flow into the air brush where it is subsequently propelled out of the air brush. The further back the needle is pulled from its resting position, the more paint that is allowed to flow. The regulation of the trigger has generally been the means by which air and paint flow have been governed.

The paint regulating needle of the more accurate airbrushes is generally made with considerable precision. The more precisely the needle is made the greater control the artist has in releasing the amount of paint desired. As a result as paint traverses the needle on its way out of the airbrush some is inevitable left or collects on the needle affecting the accuracy of the airbrush. This is particularly true when the airbrush has been used and use has stopped allowing the paint in the airbrush, and on the needle, to dry. In order to remove this paint the artist has had to disassemble the airbrush, remove the needle and clean it. Such an operation is time consuming and is often avoided in the interest of finishing the painting job quickly. By avoiding cleaning the needle, precision in the art is sacrificed by the artist. Further, when the user selects a new color with which to continue the airbrush work the needle must be completely cleaned or the original color will taint the new color.

In the present invention, we have provided a novel needle and handle that allow for the removal of the needle for cleaning, or replacing, without having to disassemble the entire airbrush. In this way the precise work of the artist can be maintained with little or no time loss.

It is therefore an object of the present invention to provide an air brush in which the user may remove the needle for cleaning or replacing without disassembling the entire airbrush.

It is a further object of the present invention to allow great accuracy in using an airbrush by allowing for the quick cleaning or replacing of the paint regulating needle.

Other objects and advantages of the present invention will become apparent as the description proceeds.

SUMMARY OF THE INVENTION

In accordance with the present invention, an air brush having a handle, a front body and a paint regulating needle is provided. The handle and front body define a tubular cavity and a longitudinal axis. The handle has a proximal end and a distal end and the proximal end of the handle defines an opening about the longitudinal axis.

The handle also defines a portal between the proximal end and the distal end of the handle. The paint regulating needle has a proximal end and a distal end and the proximal end has a stop. The paint regulating needle is releasably held within the tubular cavity, formed in the front body and handle, at the portal in the handle. The stop of the paint regulating needle extends proximally from the handle and is designed so that the needle can be easily grasped. The paint regulating needle being removable from the airbrush when the needle is released, at the portal, and pulled from the airbrush.

In the illustrative embodiment of the present invention, a needle chuck is provided at the portal to releasably hold the needle within the airbrush. The unscrewing of the needle chuck allows the removal of the needle. Further, in the illustrative embodiment, a collar with calibrations is provided to assist in the determination of exact and consistent paint flow settings and in accurately re-setting paint flow settings, when for example, the paint regulating needle is removed and then replaced. Further, the illustrative embodiment is provided with means to set maximum paint flow settings as well, as will be described below.

A more detailed explanation of the invention is provided in the following description and claims and is illustrated in the accompanying drawings.

DETAILED DESCRIPTION OF THE ILLUSTRATIVE EMBODIMENT

Figure 1:
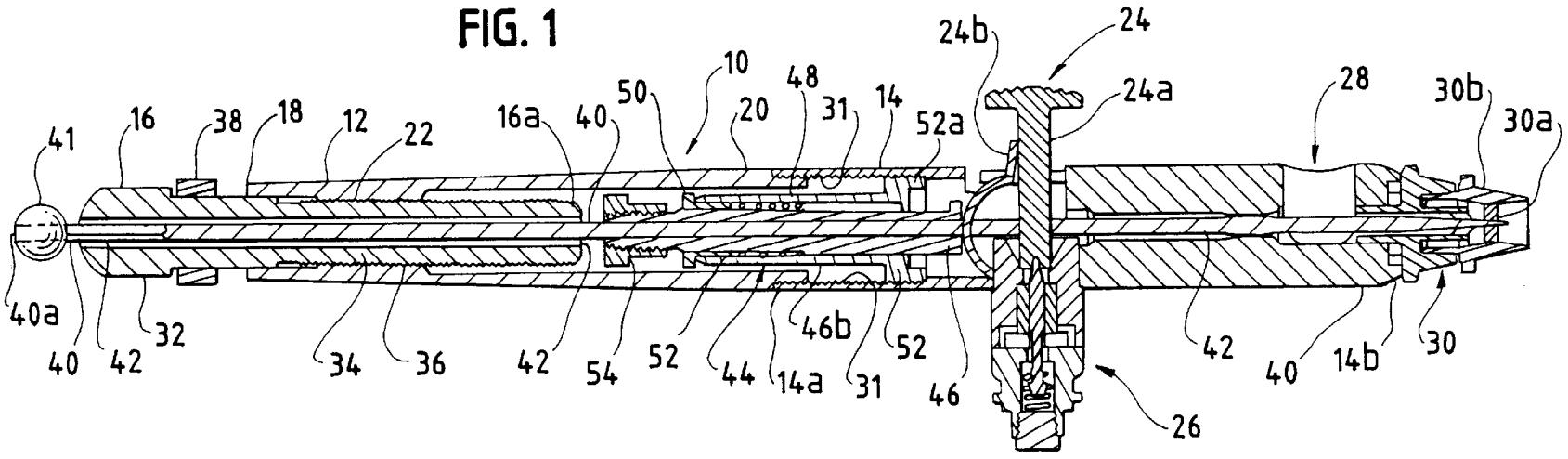
FIG. 1 is a cross-sectional view of an air brush made in accordance with the present invention.

Referring to the drawings, FIG. 1 shows an air brush 10 having a handle 12, a front body 14 and an adjusting screw 16. Handle 12 comprises a cylindrical body having a proximal end 18 and a distal end 20. Handle 12 further comprises threads 22 within proximal end 18.

Front body 14 comprises a cylindrical body having a proximal end 14*a* and a distal end 14*b*. Front body 14 further comprises a trigger assembly 24, comprising a trigger 24*a* and a back lever 24*b*, and an air intake assembly 26. A paint intake assembly 28 and a nozzle assembly 30 are also provided on front body 14. Air intake assembly 26 and paint intake assembly 28 are conventional and well known in the art. Front body 14 also defines threads 31 in its interior wall of proximal end 14*a*.

Figure 2:
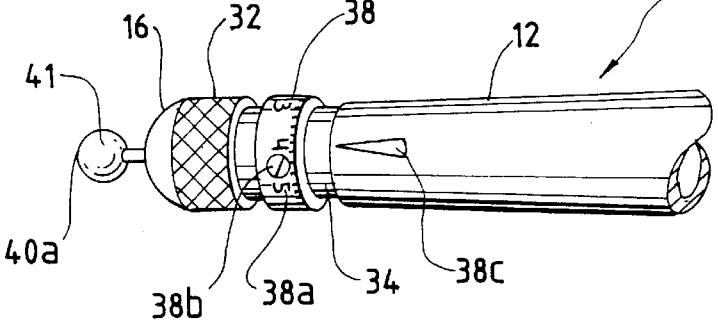
FIG. 2 is a perspective view, partially cut away, of the proximal end of an air brush made in accordance with the present invention.

Adjusting screw 16 comprises a generally cylindrical body having a first section 32, which has a diameter greater than the interior diameter of the proximal end 18 of handle 12, and a second section 34 having a diameter smaller than the interior diameter of the proximal end 18 of handle 12. Second section 34 defines threads 36. Threads 36 of adjusting screw 16 engage threads 22 of handle 12 such that adjusting screw 16 may be further screwed into handle 12 or out from handle 12 as desired. The distal end 16*a* of adjusting screw 16 extends within handle 12. In the illustrative embodiment, a collar 38 having calibrations 38*a* (see FIG. 2) is provided to assist the operator of air brush 10 in determining and setting an ideal paint flow position.

Air brush 10 further comprises a paint regulating needle 40, which traverses a central cavity 42 defined in front body 14, handle 12 and adjusting screw 16. Paint regulating needle 40 is integral to the determination of the amount of paint that is allowed to escape from nozzle assembly 30 through aperture 30*a*, and is controlled, in the illustrative embodiment, by trigger assembly 24. A stop 41 is located at or adjacent the proximal end 40*a* of paint regulating needle 40. In the illustrative embodiment, stop 41 is die cast onto paint regulating needle 40. It is to be understood that stop 41 can be constructed of any number of materials, including, but not limited to, brass, steel and plastics, can be formed in any number of shapes, including, but not limited to, spherical, cubical, cylindrical, plumb-bob-shaped or pear-shaped, and can be attached to paint regulating needle 40 in any number of ways including, but not limited to, forging, swaging, adhesives or welding. Further, stop 41 can be formed as an integral part of paint regulating needle 40, either when paint regulating needle 40 is manufactured or by any method of material manipulation of the finished paint regulating needle 40.

Within handle 12 and front body 14, air brush 10 further comprises a needle managing assembly 44. Needle managing assembly 44 comprises needle tube 46, spring 48, spring screw 50, tube shank 52 and needle chuck 54. Needle managing assembly 44 is held by tube shank 52 within front body 14 and extends into handle 12. Tube shank 52 defines threads 52*a* which are screwed into threads 31 of front body 14. It can be seen that needle managing assembly 44 may be set at any point along threads 31 of front body 14. The setting of needle managing assembly 44 allows the tension in spring 48 to be adjusted. Tension in spring 48 can also be adjusted by tightening or loosening, as desired, spring screw 50.

Needle tube 46 is generally cylindrical, defining part of central cavity 42 therethrough. The outer diameter of needle tube 46 tapers at its proximal end. Needle tube 46 defines threads 46*a* near its proximal end (see FIG. 3). Needle chuck 54 comprises a tube 54*a* and a crown 54*b*. Tube 54*a* defines threads 54*c* about its interior surface (see FIG. 4). Crown 54*b* defines an opening 54*d* therethrough. Opening 54*d* has a diameter, at its distal end, substantially equal to the interior diameter of tube 54*a*. Opening 54*d* tapers to a substantially smaller diameter at its proximal end. When paint regulating needle 40 is placed into needle tube 46 and needle chuck 54 is tightened, with threads 54*c* onto threads 46*a*, paint regulating needle 40 is releasably held fixed relative to needle tube 46. When needle chuck 54 is loosened paint regulating needle 40 may be removed from airbrush 10.

Needle tube 46 is held in tube shank 52 by means of spring screw 50. A spring 48 is first placed coaxially to needle tube 46 and then spring screw 50 is threaded onto tube shank 52. Spring 48 is held against spring screw 50 by lip 46*b* of needle tube 46. Paint regulating needle 40, when held by needle chuck 54, is thereby biased towards front body 14 as spring 48 exerts its force against lip 46*b* of needle tube 46.

Nozzle assembly 30 (see FIG. 1) comprises a cone 30*b* which defines an aperture 30*a* through which paint regulating needle 40 emerges when air brush 10 is not in operation. Nozzle assembly 30 comprises other parts which are known to persons having ordinary skill in the art. In the nozzle assembly 30 paint and air are mixed, atomization of paint particles occurs and atomized paint is propelled from air brush 10 towards the object to be painted.

In the normal operation of an air brush 10, a source of pressurized gas and a source of paint are provided. Trigger 24*a* is depressed and pulled back. The depressing of trigger 24*a* opens a valve in air intake assembly 26 allowing pressurized air to enter the air brush 10. The pulling back of trigger 24*a* causes back lever 24*b* to push against needle tube 46 which pulls paint regulating needle 40 out of cone 30*b*. As paint regulating needle 40 is pulled out of cone 30*b*, paint is allowed to flow out of air brush 10, in a manner well known in the art, and painting occurs. The further paint regulating needle 40 is pulled back the more paint that is allowed to flow out of air brush 10.

In the paint flow regulated operation of air brush 10, two methods of paint regulation are provided.

Figure 4:
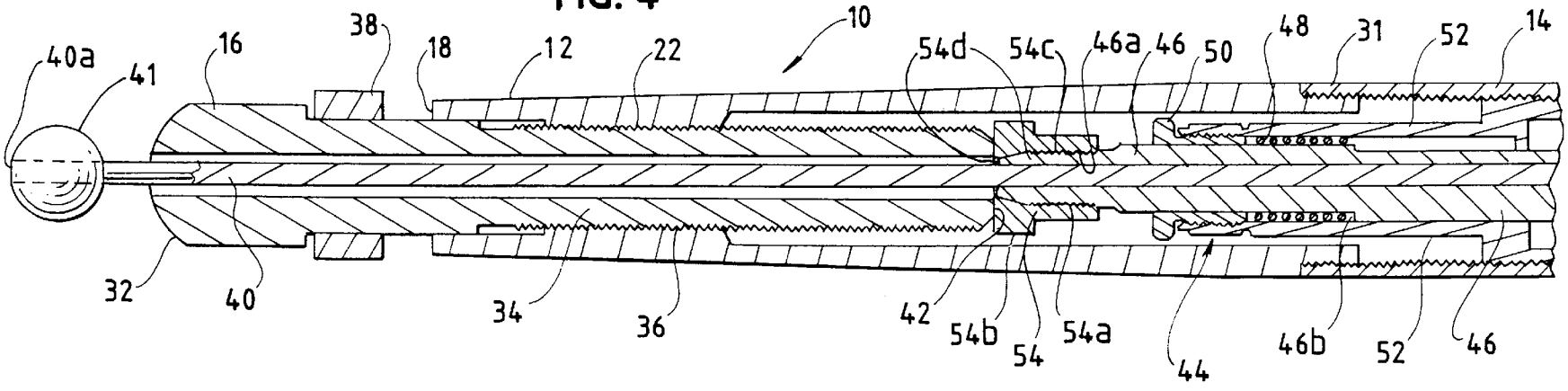
FIG. 4 is a partially cut away cross-sectional view of an air brush made in accordance with the present invention with the adjusting screw in a second position.

In the first method, adjusting screw 16 is turned so that adjusting screw 16 further enters handle 12 to a desired point proximate to needle chuck 54. When trigger assembly 24*a* is pulled back, to spray paint, needle chuck 54 will be pushed backwards until it strikes the distal end of adjusting screw 16, as shown in FIG. 4. As needle chuck 54 is restricted in movement, so is paint regulating needle 40. This regulates the amount of paint that can be propelled from air brush 10. As adjusting screw 16 is further screwed into handle 12, needle chuck 54 will strike adjusting screw 16 sooner and less paint will be allowed out of air brush 10. In this way a maximum desired amount of paint may be set by the operator of the air brush and the operator never accidentally applies more than the desired amount of paint. Further, adjusting screw 16 may be moved in or out, as desired, while the air brush 10, is in operation.

Figure 3:
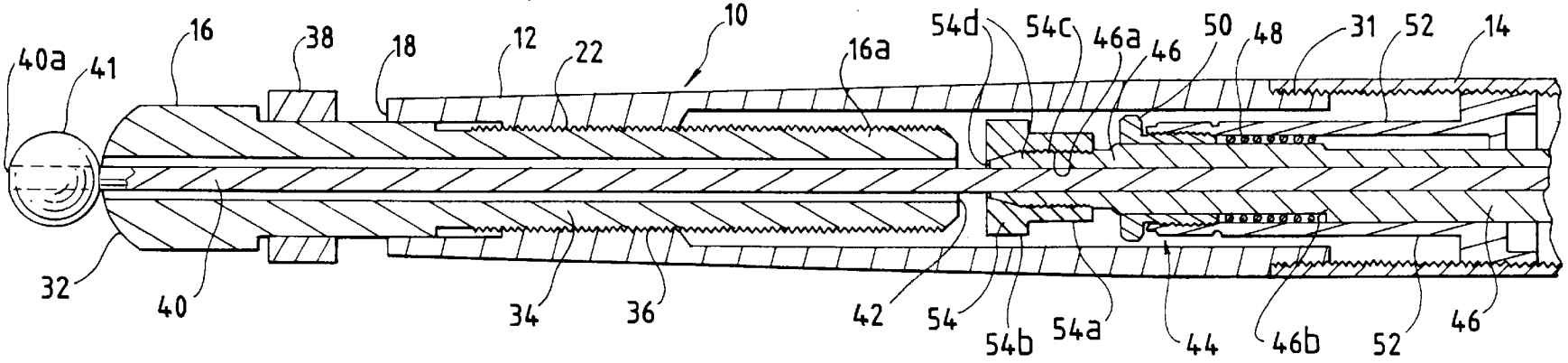
FIG. 3 is a partially cut away cross-sectional view of an air brush made in accordance with the present invention with the adjusting screw in a first position.

In the second method of paint regulation, adjusting screw 16 is unscrewed so that it emerges from handle 12 and pushes against stop 41, as shown in FIG. 3. As stop 41 is pushed back from its initial rest position, paint regulating needle 40 is also pulled back causing aperture 30*a* to be open. When trigger 24*a* is depressed, paint is allowed to flow without the operator pulling trigger 24*a* backwards as paint regulating needle 40 has already been withdrawn from aperture 30*a*. In this way, the operator may determine the desired paint flow rate and maintain that rate by merely depressing trigger 24*a* without pulling trigger 24*a* back. The operator may, if desired, increase the rate of flow by pulling trigger 24*a* back and then return to the set paint flow by pushing the trigger 24*a* forward. In this way a minimum desired flow of paint may be set by the operator of the air brush, so that the operator never accidentally applies less than the desired amount of paint. Painting is stopped when trigger 24*a* is released. In the illustrative embodiment, a collar 38 having calibrations 38*a* is provided on adjusting screw 40 to permit the operator to set with accuracy the desired paint flow.

Figures 5, 6, 7:
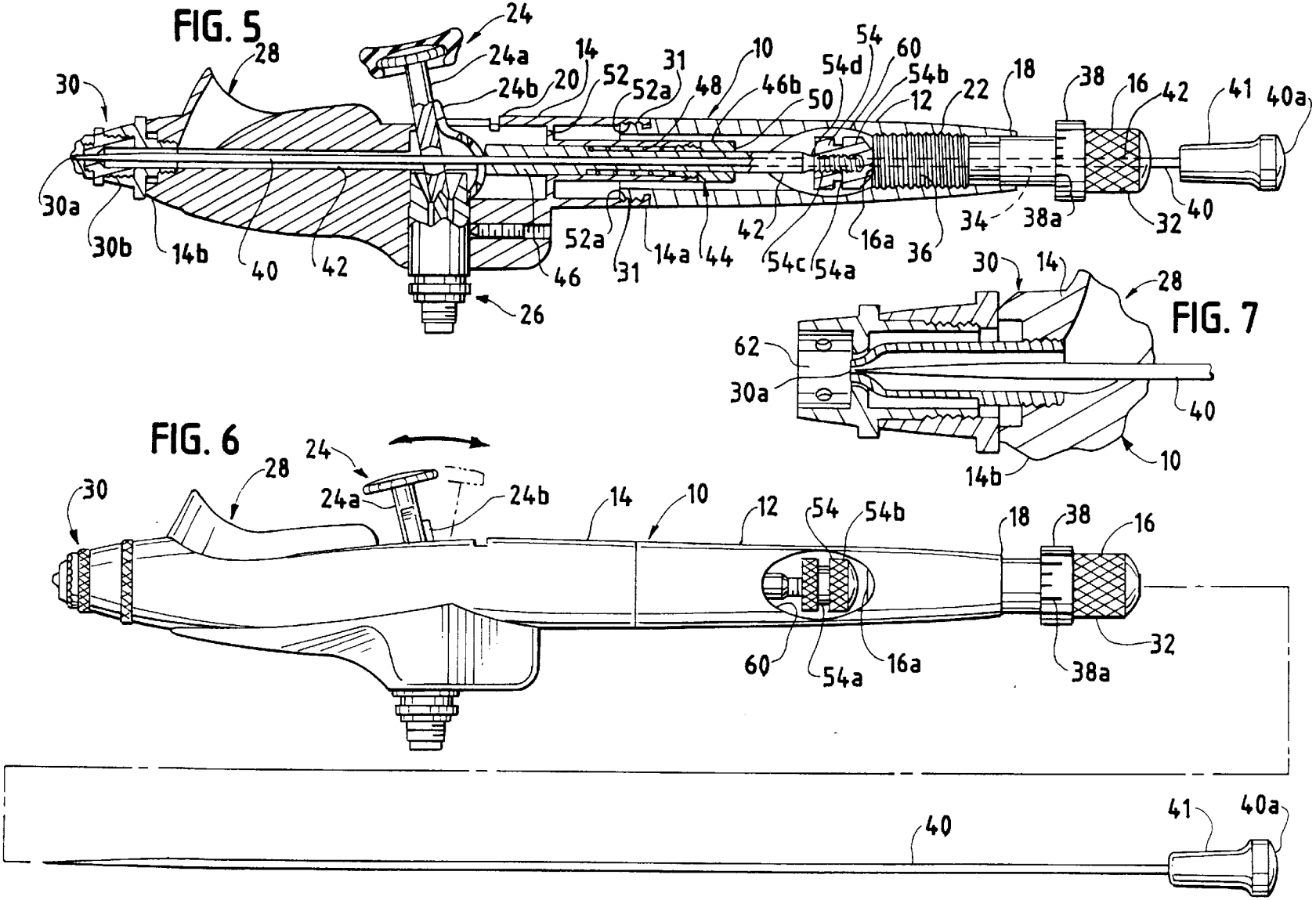
FIG. 5 is an cross-sectional view of another embodiment of an airbrush made in accordance with the present invention.
FIG. 6. is an elevational view of the airbrush of FIG. 5 having its paint regulating needle removed.
FIG. 7 is a cross-sectional view of the front end of an airbrush, made in accordance with the present invention, showing a different configuration of the nozzle assembly.

In the operation of an air brush 10, paint often causes clogs, particularly when the air brush 10 has been allowed to sit between applications. In the illustrative embodiment, should clogging occur during minimum paint flow regulation settings the operator may retract paint regulating needle 40, to allow for the clearing of paint clogs in the paint path 43, by taking hold of stop 41 and pulling it back. Methods of clearing the paint path 43, known to users of air brushes, can then be applied. Upon its release, stop 41 and paint regulating needle 40 will return to their preset locations. Further, for more complete cleaning and when using the maximum paint flow regulation settings, collar 38 is provided with calibrations 38*a* that allow for the accurate recreation of desired settings (see FIG. 2). Further, should a more thorough cleaning or replacement of paint regulating needle 40 be required, needle chuck 54 may be loosened, through portal 60 (see FIG. 5 and FIG. 6) and paint regulating needle 40 may then be pulled, by stop 41, completely, or as far as necessary, out of airbrush 10 for cleaning or replacing (see FIG. 6). This method of cleaning is particularly important when using a nozzle assembly 30 of the type illustrated in FIG. 7 having a protective sleeve 62. Because the protective sleeve 62 covers the paint regulating needle 40, effective cleaning of the end of the paint regulating needle 40 without pulling it from airbrush 10 would be nearly impossible. The removal of paint regulating needle 40 from airbrush 10 further allows the replacement of paint regulating needle 40 with either a different type of needle (allowing different types of painting effects) or with a clean needle to facilitate and expedite the changing of paint color.

In the operation of the calibrated collar 38 of the illustrate embodiment of the present invention, prior to setting the desired paint flow, the operator may turn adjusting screw 16 to either a minimum flow first position, the position where adjusting screw 16 first makes contact with stop 41, or to a maximum flow first position, the position where adjusting screw 16 first abuts needle chuck 54. The operator may then unscrew calibration screw 38*b* and place the "0" calibration number adjacent to calibration marker 38*c*; calibration screw 38*b* may then be re-tightened, thus calibrating the collar 38. The operator then rotates the adjusting screw to the desired setting, either minimum flow or maximum flow, and notes the number on the calibration collar 38 adjacent to the calibration marker 38*c* on handle 12. By setting the adjusting screw 16 to the desired paint flow position and noting the number on the calibration collar 38, the operator can recreate the setting, after cleaning the airbrush or changing paint colors, by following the above noted steps and returning the calibration collar 38 to the noted calibration number representing the desired flow setting.

Although an illustrative embodiments of the invention have been shown and described, it is to be understood that various modifications and substitutions may be made by those skilled in the art without departing from the novel spirit and scope of the invention.

What is claimed is:

1. An air brush which comprises:

a handle;

a front body;

a paint regulating needle;

said handle and front body defining a tubular cavity, and a longitudinal axis;

said handle having a proximal end and a distal end;

said proximal end of said handle defining an opening about said longitudinal axis;

said handle defining a portal between said proximal end and said distal end of said handle;

said paint regulating needle having a proximal end portion and a distal end, said proximal end portion having a stop;

said paint regulating needle being releasably held within said tubular cavity at said portal in said handle;

said paint regulating needle being removable from said proximal end of said airbrush when said needle is released.

2. The airbrush of claim 1 including a needle chuck for releasably holding said regulating needle, said needle chuck being accessible to the operator at said portal.

3. The airbrush of claim 1 including a trigger assembly, said paint regulating needle being reactive to said trigger assembly such that proximal and distal movements of said trigger assembly cause the proximal and distal, respectively, movements of said paint regulating needle.

4. The airbrush of claim 1 in which from an initial position said stop on said regulating needle may be grasped and pulled proximally such that upon release said stop will return to said initial position.

5. The airbrush of claim 1 including a spring to bias said paint regulating needle forward in said tubular cavity.

6. The airbrush of claim 5 in which an adjusting screw defining a tubular cavity is provided between said proximal end of said handle and said needle stop, said adjusting screw being threaded into said opening defined in said proximal end of said handle, said adjusting screw being rotatable so as to extend distally or proximally, as desired, within or out of said handle, whereby said adjusting screw may be rotated to extend further proximally from said handle and push against said stop on said paint regulating needle and against said spring, biasing said needle forward, to pull said distal end of said paint regulating needle proximally from said distal end of said front body and fix said paint regulating needle at a desired paint flow position.

7. An air brush which comprises:

a handle;

a front body;

a paint regulating needle;

a needle chuck;

a trigger assembly;

said handle and front body defining a tubular cavity, and a longitudinal axis;

said handle having a proximal end and a distal end;

said proximal end of said handle defining an opening about said longitudinal axis;

said handle defining a portal between said proximal end and said distal end of said handle;

said paint regulating needle having a proximal end portion and a distal end, said proximal end portion having a stop;

said paint regulating needle being releasably held by said needle chuck within said tubular cavity at said portal in said handle;

said paint regulating needle being removable from said proximal end of said airbrush when said needle is released.

8. A method for removing a paint regulating needle from an airbrush which comprises the steps of:

providing a handle having a portal;

providing a paint path in said airbrush;

providing a paint regulating needle extending proximally from said handle and distally through said paint path;

releasably holding said paint regulating needle at said portal in said handle;

releasing said paint regulating needle through said portal and pulling said paint regulating needle proximally from said handle out of said airbrush.

9. A method of replacing a paint regulating needle in an airbrush comprising the steps of:

providing a handle having a portal;

providing a paint regulating needle in said airbrush;

releasably holding said paint regulating needle at said portal in said handle;

releasing said paint regulating needle through said portal and pulling said paint regulating needle proximally from said handle out of said airbrush; and placing said paint regulating needle in said airbrush and releasably holding said paint regulating needle through said portal.

* * * * *